US007377385B2

(12) United States Patent
Giannini et al.

(10) Patent No.: US 7,377,385 B2
(45) Date of Patent: May 27, 2008

(54) RIGID CARTON OF PACKETS OF CIGARETTES INCLUDING FINGER HOLE

(75) Inventors: Antonella Giannini, Bologna (IT); Stefano Chini, San Lazzaro Di Savena (IT); Fiorenzo Draghetti, Medicina (IT)

(73) Assignee: G.D Societa' per Azioni, Bologna (IT)

( * ) Notice: Subject to any disclaimer, the term of this patent is extended or adjusted under 35 U.S.C. 154(b) by 273 days.

(21) Appl. No.: 10/518,806

(22) PCT Filed: Jun. 23, 2003

(86) PCT No.: PCT/IT03/00387

§ 371 (c)(1),
(2), (4) Date: Jun. 23, 2005

(87) PCT Pub. No.: WO04/000690

PCT Pub. Date: Dec. 31, 2003

(65) Prior Publication Data

US 2005/0241966 A1 Nov. 3, 2005

(30) Foreign Application Priority Data

Jun. 24, 2002 (IT) ..... BO2002A0401

(51) Int. Cl.
*B65D 85/10* (2006.01)
*B65D 5/38* (2006.01)

(52) U.S. Cl. ..... 206/267; 206/273; 229/125.125

(58) Field of Classification Search ..... 206/242–275, 206/815; 229/125.125, 122
See application file for complete search history.

(56) References Cited

U.S. PATENT DOCUMENTS

| | | | | | |
|---|---|---|---|---|---|
| 1,597,652 | A | * | 8/1926 | Kadan | 229/125.125 |
| 2,541,173 | A | * | 2/1951 | Arlington | 229/125.125 |
| 2,771,988 | A | * | 11/1956 | Sweeney | 206/242 |
| 3,083,820 | A | * | 4/1963 | Roberts | 206/264 |
| 3,302,844 | A | * | 2/1967 | Warren | 229/125.125 |
| 3,489,272 | A | * | 1/1970 | Rosen | 206/256 |
| 4,185,763 | A | * | 1/1980 | Geraedts | 229/125.125 |
| 4,534,463 | A | * | 8/1985 | Bouchard | 206/267 |
| 4,779,723 | A | * | 10/1988 | Focke et al. | 206/273 |
| 5,080,227 | A | * | 1/1992 | Focke | 206/273 |
| 5,088,599 | A | * | 2/1992 | Mahler | 229/125.125 |
| 5,147,037 | A | * | 9/1992 | Evers et al. | 206/256 |
| 5,662,215 | A | * | 9/1997 | Focke et al. | 206/273 |
| 6,491,212 | B1 | * | 12/2002 | Militzer | 229/125.125 |

FOREIGN PATENT DOCUMENTS

| | | |
|---|---|---|
| DE | 90 03 536 U | 6/1990 |
| EP | 1 066 206 A | 1/2001 |
| FR | 2 499 947 A | 8/1982 |
| GB | 431 721 A | 7/1935 |
| WO | 00 10892 A | 3/2000 |
| WO | 00 43289 A | 7/2000 |

* cited by examiner

*Primary Examiner*—Bryon P. Gehman
(74) *Attorney, Agent, or Firm*—Ladas and Parry LLP

(57) ABSTRACT

A rigid carton of packets of cigarettes, having a first container, which houses a group of packets of cigarettes and is in turn housed inside a second container so as to slide, with respect to the second container, between a closed position wherein the first container is fully inserted inside the second container, and an open position wherein part of the first container is extracted from the second container.

24 Claims, 5 Drawing Sheets

RIGID CARTON OF PACKETS OF CIGARETTES INCLUDING FINGER HOLE

TECHNICAL FIELD

The present invention relates to a rigid carton of packets of cigarettes.

BACKGROUND ART

A rigid carton of packets of cigarettes is normally defined by a parallelepiped-shaped container formed by folding a blank about a group of five/ten packets of cigarettes, and having a top portion which is torn open by the user along a precut tear line to extract the packets of cigarettes. A user normally removes one packet of cigarettes at a time from the carton at intervals normally ranging between one and three days, so the carton is used for three to thirty days by a normal user, depending on the number of packets of cigarettes in the carton (normally five or ten) and the number of cigarettes normally smoked by the user. Once the carton is opened, however, e.g. by tearing along a precut tear line, it cannot be closed again, as normally required in the case of relatively prolonged use. Known rigid cartons of packets of cigarettes also fail to provide for adequate mechanical protection of the packets.

WO-0010892-A discloses a carton for containing a plurality of packs of cigarettes and having a shell and slide construction. One end of the shell is partially open to allow the user to push the lidded slide, containing packs of cigarettes, to an open position; this is defined by a hooking engagement between shell and slide to expose just a little more of a lid of the slide than a detachable portion, which is detached by the user to expose only one pack at a time for extraction from the carton. However, the rigid carton of packets of cigarettes disclosed by WO-0010892-A is relatively complex and thus expensive to produce.

DISCLOSURE OF INVENTION

It is an object of the present invention to provide a rigid carton of packets of cigarettes, designed to eliminate the aforementioned drawbacks, and which, in particular, is cheap and easy to produce.

According to the present invention, there is provided a rigid carton of packets of cigarettes, the carton comprising a first container for a group of packets of cigarettes, a second container housing the first container in sliding manner, so as to enable the first container to slide, with respect to the second container, between a closed position wherein the first container is fully inserted inside the second container, and an open position wherein part of the first container is extracted from the second container; the first container being cup-shaped, and comprising an open top end, a bottom wall opposite the open top end, two opposite parallel lateral walls, and two opposite parallel, respectively front and rear, end walls; the carton being characterized in that the bottom wall of the first container comprises at least one through hole sized to permit insertion of a user's finger.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
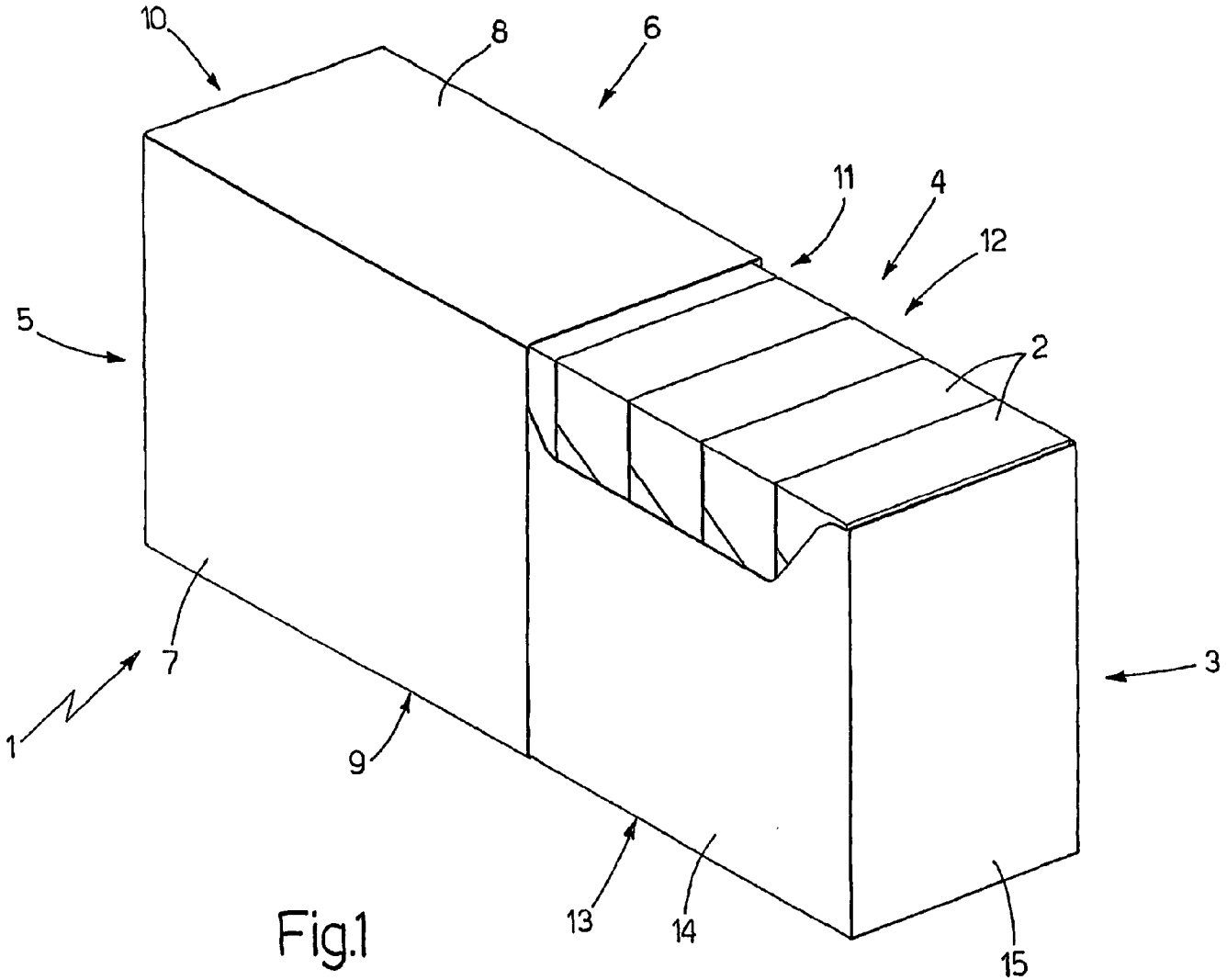
FIG. 1 shows a front view in perspective of a preferred embodiment of a rigid carton of packets of cigarettes in accordance with the present invention and in an open configuration.

Number 1 in the accompanying drawings indicates as a whole a rigid carton of packets 2 of cigarettes, comprising a container 3 for a group 4 of packets 2 of cigarettes, and a container 5 housing container 3 in sliding manner, so as to enable container 3 to slide, with respect to container 5, between a closed position (FIG. 3) wherein container 3 is fully inserted inside container 5, and an open position (FIG. 1) wherein part of container 3 is extracted from container 5.

Each packet 2 of cigarettes is parallelepiped-shaped with two end walls and a lateral surface, which is bounded by the end walls and defined by two major, respectively front and rear, lateral walls, and by two minor lateral walls. In the embodiment shown in FIGS. 1, 2 and 3, group 4 of packets 2 of cigarettes comprises one row of packets 2 of cigarettes, in which the major lateral walls of packets 2 of cigarettes are arranged contacting one another; and, in the FIG. 6 embodiment, group 4 of packets 2 of cigarettes comprises two side by side rows of packets 2 of cigarettes, in each of which the minor lateral walls of packets 2 of cigarettes are arranged contacting one another.

Figure 2:
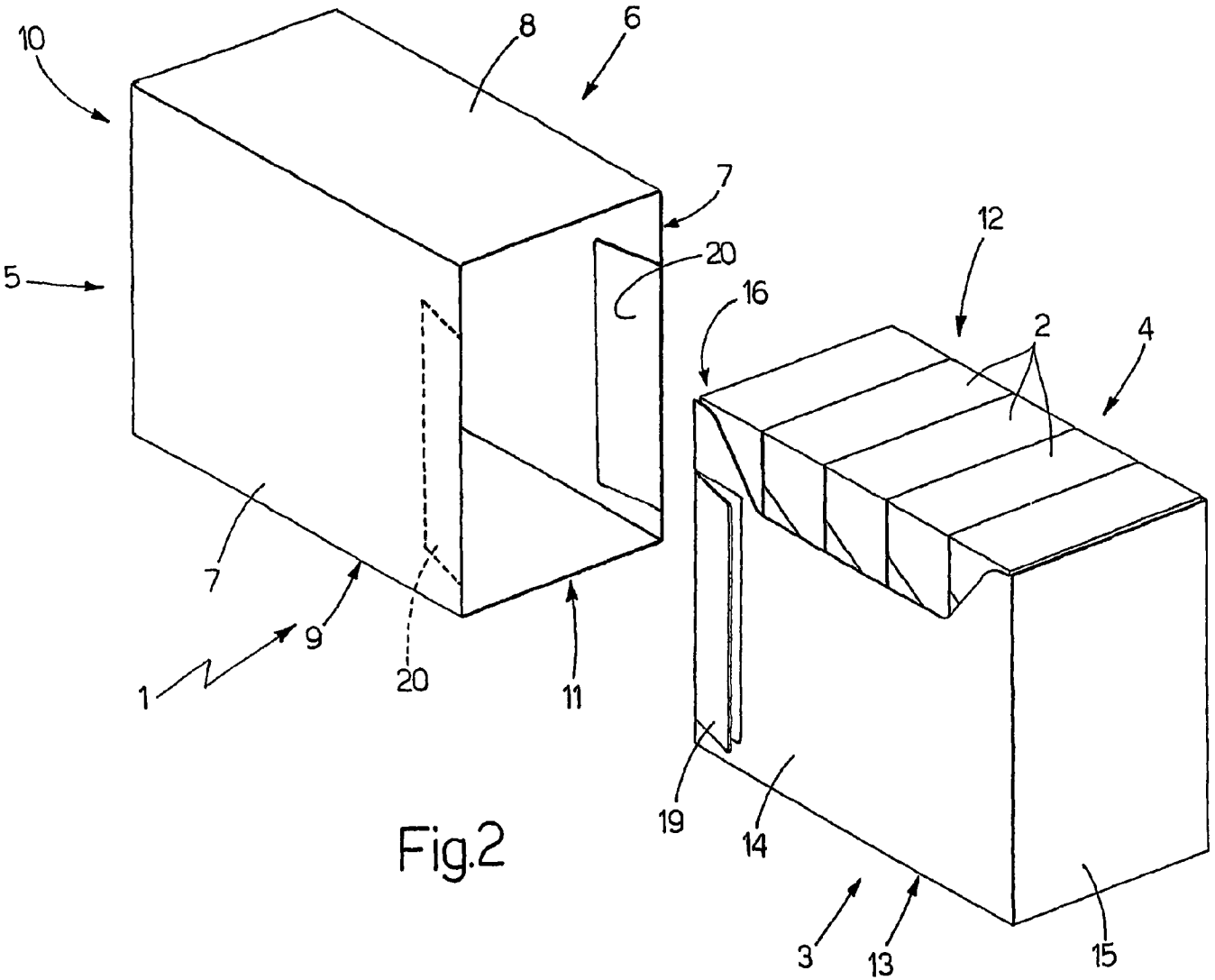
FIG. 2 shows an exploded view in perspective of the FIG. 1 carton.
Figure 3:
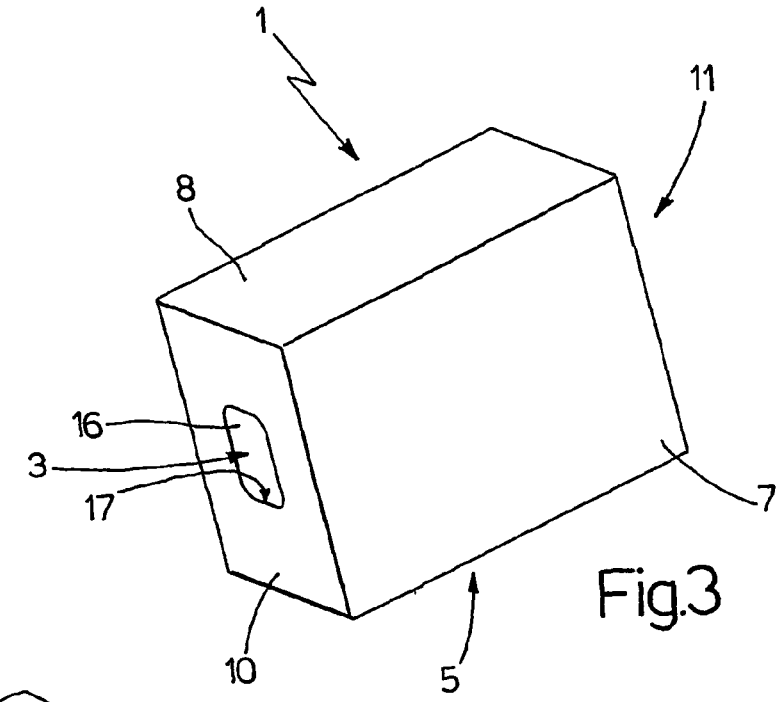
FIG. 3 shows a rear view in perspective of the FIG. 1 carton in a closed configuration.

As shown in FIGS. 1, 2 and 3, container 5 is in the form of a tubular parallelepiped defined by a lateral surface 6, which comprises two opposite parallel lateral walls 7, a top wall 8, a bottom wall 9 opposite and parallel to top wall 9, one end closed by an end wall 10, and an opposite end having an opening 11 through which container 3 slides between said closed position (FIG. 3) and said open position (FIG. 1).

Container 3 is cup-shaped, and comprises an open top end 12, a bottom wall 13 opposite open top end 12, two opposite parallel lateral walls 14, and two opposite parallel, respectively front and rear, end walls 15 and 16. When container 3 is in said closed position (FIG. 3), each lateral wall 14 of container 3 is parallel to and faces a respective lateral wall 7 of container 5; bottom wall 13 of container 3 is parallel to and faces bottom wall 9 of container 5; open top end 12 of container 3 faces top wall 8 of container 5; rear end wall 16 of container 3 is parallel to and faces end wall 10 of container 5; and front end wall 15 of container 3 faces opening 11 of container 5.

Container 3 is sized to house group 4 of packets 2 of cigarettes with a small amount of clearance, and container 5 is sized to house container 3 with a small amount of clearance, thus minimizing the amount of packaging material required to produce containers 3 and 5, while at the same time minimizing the movement of packets 2 of cigarettes inside container 3, and the movement of container 3 inside container 5. Obviously, the clearance between packets 2 of cigarettes and container 3 cannot be totally eliminated, to enable packets 2 of cigarettes to be removed easily from container 3 by the user, and the clearance between container 3 and container 5 cannot be totally eliminated, to enable the user to extract container 3 easily from container 5.

End walls 15 and 16 of container 3 are substantially the same size as a packet 2 of cigarettes, while lateral walls 14 of container 3 vary in height, are the same height as end walls 15 and 16 and packets 2 of cigarettes close to end walls 15 and 16, and are smaller in height than end walls 15 and 16 and packets 2 of cigarettes between end walls 15 and 16.

Figure 5:
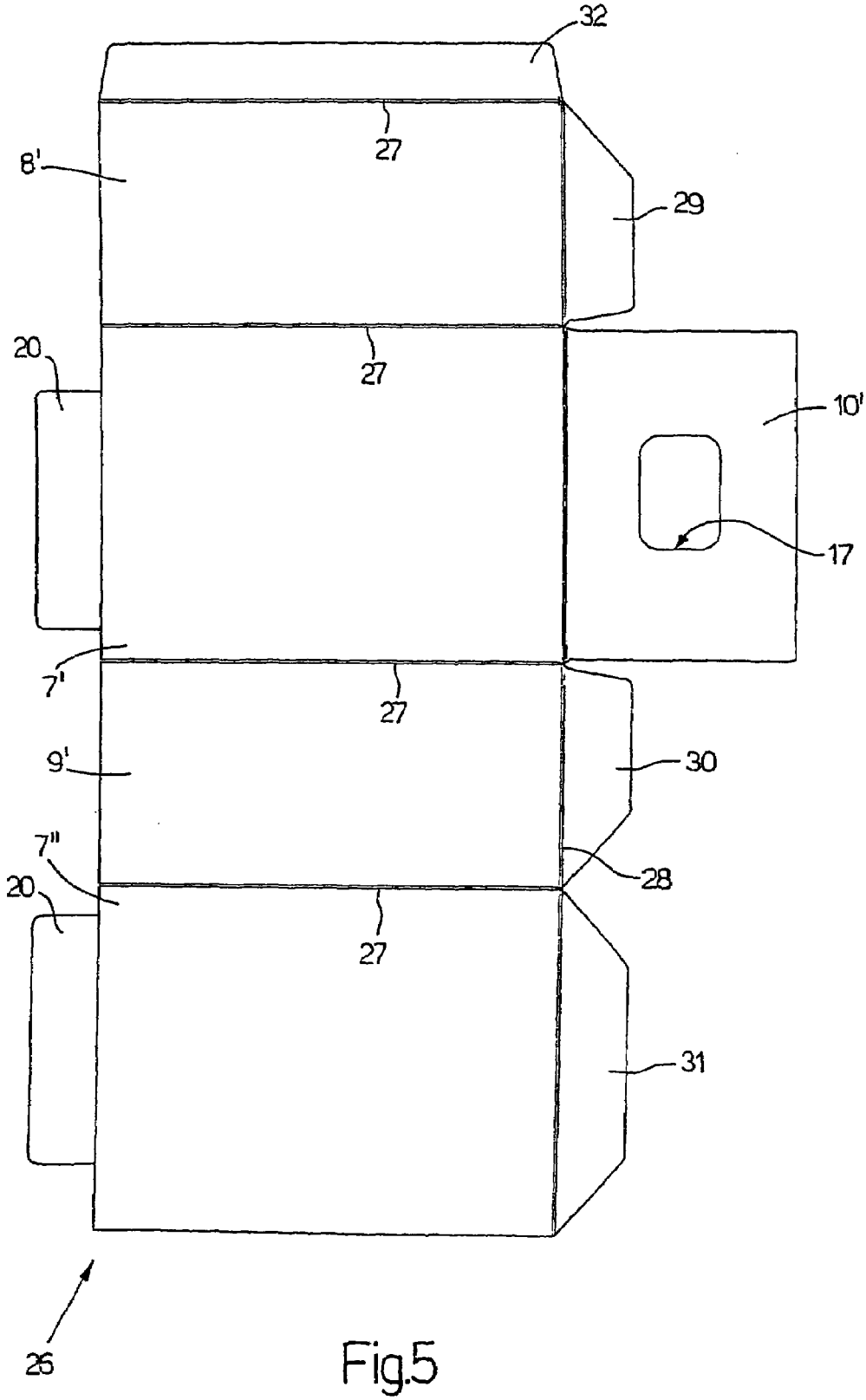
FIG. 5 shows a plan view of a blank from which to form an outer container of the FIG. 1 carton.

In the embodiment shown in FIGS. 1, 2 and 3, end wall 10 of container 5 has a hole 17 (FIG. 3) shaped and sized to permit insertion of the user's finger. By way of example, the hole 17 shown in FIG. 5 is rectangular with rounded corners, and ranges in size between 20×15mm and 30×20 mm. The purpose of hole 17 is to assist extraction of container 3 from container 5, as of the closed position, by enabling the user to push on rear end wall 16 of container 3. In a variation not shown, wall 10 may be dispensed with entirely.

Figure 6:
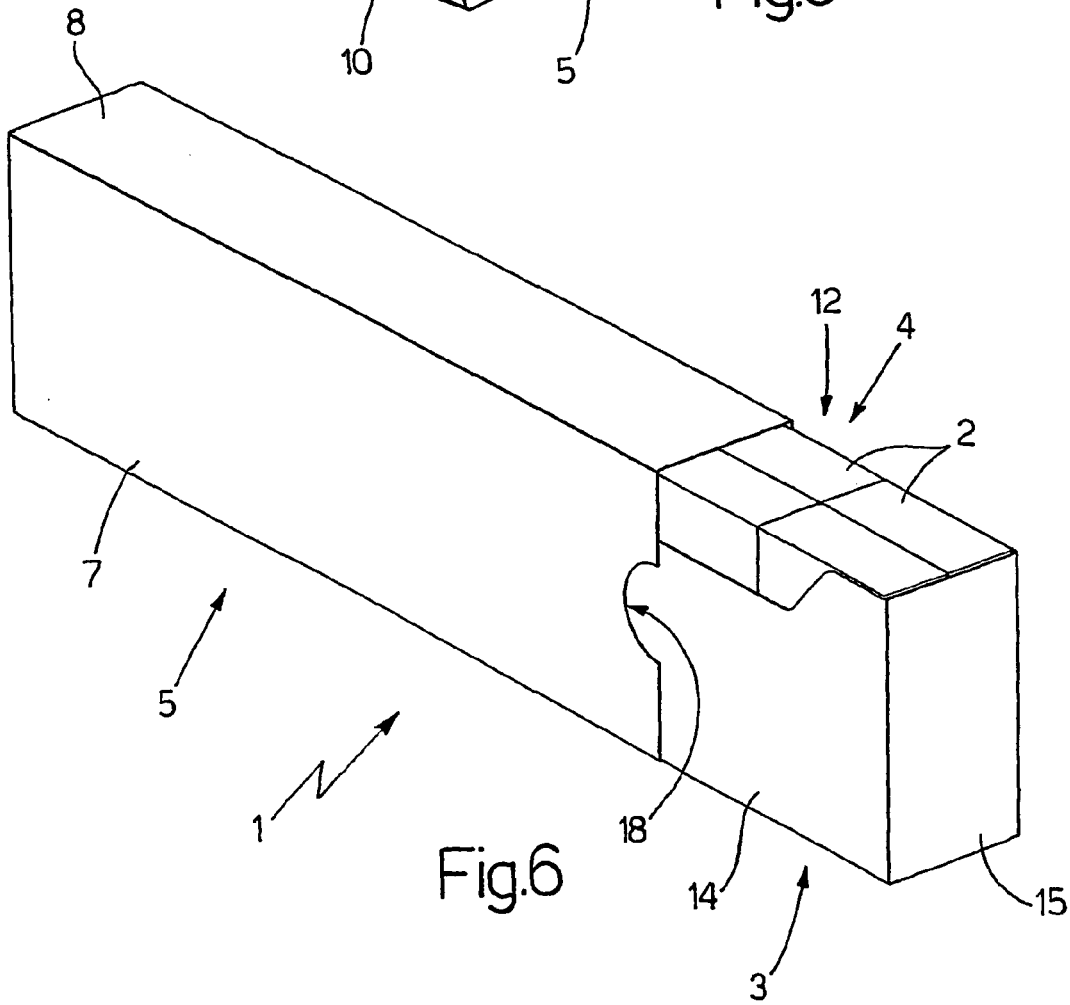
FIG. 6 shows a front view in perspective of an alternative embodiment of a rigid carton of packets of cigarettes in accordance with the present invention and in an open configuration.

In the FIG. 6 embodiment, each lateral wall 7 of container 5 has a recess 18 close to opening 11. More specifically, each recess 18 is in the form of a semicircle with a diameter ranging roughly between 20 mm and 30 mm. The purpose of recesses 18 is to assist extraction of container 3 from container 5, as of the closed position, by enabling the user to grip and pull on lateral walls 14 of container 3.

Carton 1 preferably comprises stop means for limiting slide of container 3 with respect to container 5 and so preventing detachment of container 3 from container 5, and which are defined by two tongues 19 projecting from lateral walls 14 of container 3, and by two tongues 20 projecting from lateral walls 7 of container 5. Each tongue 19 projects outwards of container 3 from a respective lateral wall 14 of container 3, and is located close to rear end wall 16 of container 3; each tongue 20 projects inwards of container 5 from a respective lateral wall 7 of container 5, and is located close to opening 11 of container 5; and each tongue 19 is so positioned as to engage the corresponding tongue 20 as container 3 is slid out of container 5, thus preventing detachment of container 3 from container 5.

Figure 4:
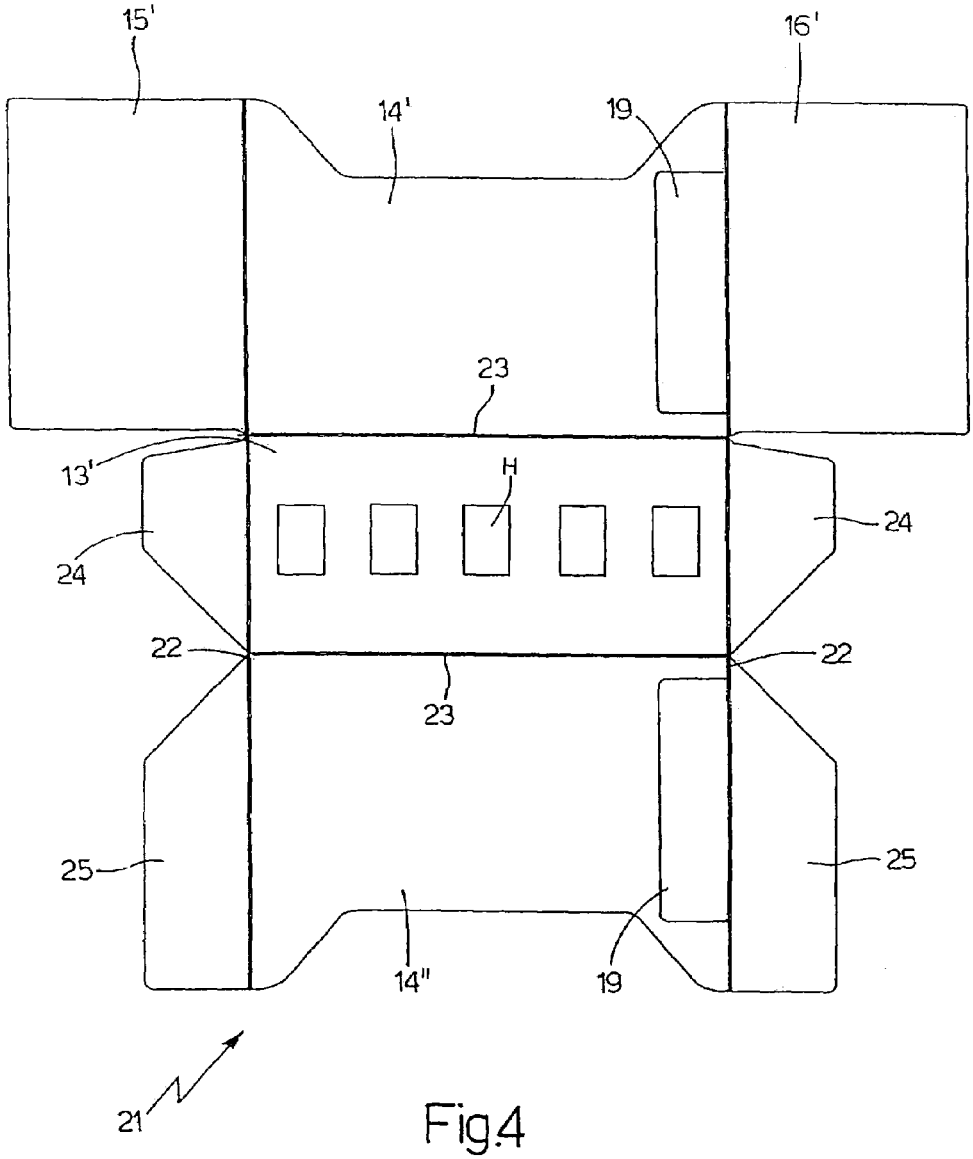
FIG. 4 shows a plan view of a blank from which to form an inner container of the FIG. 1 carton.

In a further embodiment shown in dot-lines in FIG. 4, bottom wall 13 of container 3 comprises, for each packet 2 of cigarettes, a through hole H sized to permit insertion of the user's finger, and which is located at the bottom wall of packet 2 of cigarettes to assist extraction of packet 2 of cigarettes from container 3.

In a further embodiment not shown, container 3 comprises supporting means for holding each packet 2 of cigarettes firmly in position inside container 3, and which are defined by a number of partitions inserted inside container 3 and defining a number of pockets, each for housing and holding a respective packet 2 of cigarettes firmly in place when container 3 is less than full. The partitions are normally smaller in height than lateral walls 14 of container 3, and are connected to lateral walls 14 and/or bottom wall 13 of container 3.

Carton 1 normally comprises a known overwrapping (not shown) of transparent plastic material, normally polypropylene, enclosing container 5. In an alternative embodiment, as opposed to overwrapping container 5, carton 1 comprises an overwrapping of transparent plastic material enclosing container 3 together with group 4 of packets 2 of cigarettes, to allow the user to examine group 4 of packets 2 of cigarettes before purchasing carton 1.

As shown in FIG. 4, container 3 is formed from a corresponding flat blank 21, which is substantially in the form of an elongated rectangle, and the component parts of which are indicated, where possible, using the same reference numbers, with superscripts, as for the corresponding parts of container 3.

Blank 21 comprises two longitudinal crease lines 22; and a number of transverse crease lines 23 defining, between longitudinal crease lines 22, a panel 14' defining a lateral wall 14, a panel 13' defining bottom wall 13, and a panel 14" defining the other lateral wall 14. Panel 14' has two tabs 15' and 16', which are located on opposite sides of panel 14', are separated from panel 14' by the two longitudinal crease lines 22, and define end walls 15 and 16.

Panel 13' has two tabs 24, which are located on opposite sides of panel 13', are separated from panel 13' by the two longitudinal crease lines 22, and define respective inner portions of end walls 15 and 16; panel 14" has two tabs 25, which are located on opposite sides of panel 14", are separated from panel 14" by the two longitudinal crease lines 22, and define respective inner portions of end walls 15 and 16; and tabs 24 and 25 are so shaped as not to overlap when folded onto tabs 15' and 16'.

As shown in FIG. 5, container 5 is formed from a corresponding flat blank 26, which is substantially in the form of an elongated rectangle, and the component parts of which are indicated, where possible, using the same reference numbers, with superscripts, as for the corresponding parts of container 5.

Blank 26 comprises a number of transverse crease lines 27, which define a panel 8' defining top wall 8, a panel 7' defining a lateral wall 7, a panel 9' defining bottom wall 9, and a panel 7" defining the other lateral wall 7. Panel 7' has a tab 10' separated from panel 7' by a longitudinal crease line 28 and defining end wall 10.

Panels 8', 9' and 7" have three respective tabs 29, 30 and 31, which are separated from corresponding panels 8', 9' and 7" by longitudinal crease line 28, define respective inner portions of end wall 10, and are so shaped as not to overlap when folded onto tab 10'. Panel 8' also has a tab 32 separated from panel 8' by a transverse crease line 27 and defining an inner portion of a lateral wall 7.

In an alternative embodiment not shown, the longitudinal edges (between the lateral walls and the top and bottom wall) and/or the transverse edges (between the lateral walls and end walls) of container 3 and/or container 5 may be beveled or rounded. The longitudinal edges of container 3 must, obviously, be substantially the same shape and size as the longitudinal edges of container 5 to enable container 3 to slide smoothly with respect to container 5. More specifically, the edges of container 3 may be beveled or rounded to reproduce the same shape as the edges of packets 2 of cigarettes.

In a further embodiment not shown, at least one of walls 7, 8, 9, 10, 14, 15 may have at least one arc-shaped portion close to one of its edges, exactly as described and illustrated in Patent EP 1066206.

The invention claimed is:

1. A rigid carton of packets of cigarettes, the carton comprising a first container (3) for a group (4) of said packets (2) of cigarettes comprising an open top end (12), a bottom wall (13) opposite the open top end (12), two opposite parallel lateral walls (14), and two opposite parallel, respectively front and rear end walls (15, 16); and a second container (5) housing the first container (3) in sliding manner, so as to enable the first container (3) to slide, with respect to the second container (5), between a closed position wherein the first container (3) is fully inserted inside the second container (5), and an open position wherein part of the first container (3) is extracted from the second container (5);

wherein the bottom wall (13) of the first container (3) comprises at least one first through hole sized to permit insertion of a user's finger.

2. A carton as claimed in claim 1, wherein the bottom wall (13) of the first container (3) comprises, for each packet (2) of cigarettes, a first through hole sized to permit insertion of a user's finger and located at a bottom wall of the packet (2) of cigarettes.

3. A carton as claimed in claim 1, wherein the second container (5) is substantially in the form of a tubular parallelepiped defined by a lateral surface (6), which comprises two opposite parallel lateral walls (7), a top wall (8), and a bottom wall (9) parallel to and opposite the top wall (8).

4. A carton as claimed in claim 3, wherein the second container (5) is in the form of a tubular parallelepiped having one end closed by an end wall (10), and an open end (11); when the first container (3) is in the closed position, each lateral wall (14) of the first container (3) being parallel to and facing a respective lateral wall (7) of the second container (5), the bottom wall (13) of the first container (3) being parallel to and facing the bottom wall (9) of the second container (5), the open top end (12) of the first container (3) facing the top wall (8) of the second container (5), the rear end wall (16) of the first container (3) being parallel to and facing the end wall (10) of the second container (5), and the front end wall (15) of the first container (3) facing the open end (11) of the second container (5).

5. A carton as claimed in claim 4, wherein the end wall (10) of the second container (5) has at least one second through hole (17) sized to permit insertion of a user's finger.

6. A carton as claimed in claim 4, wherein each lateral wall (7) of the second container (5) has a recess (18) close to the open end (11).

7. A carton as claimed in claim 6, wherein each recess (18) is substantially semicircular.

8. A carton as claimed in claim 4, and further comprising stop means (19, 20) for limiting slide of the first container (3) with respect to the second container (5) and so preventing detachment of the first container (3) from the second container (5).

9. A carton as claimed in claim 8, wherein the stop means (19, 20) comprise at least one first tongue (19), which projects outwards of the first container (3) from a respective lateral wall (14) of the first container (3), and is located close to the rear end wall (16) of the first container (3); and a second tongue (20), which projects inwards of the second container (5) from a respective lateral wall (7) of the second container (5), and is located close to the open end (11) of the second container (5); the first and second tongue (19, 20) being so positioned that the first tongue (19) engages the second tongue (20) as the first container (3) is slid out of the second container (5).

10. A carton as claimed in claim 4, wherein the end walls (15, 16) of the first container (3) are substantially the same size as a packet (2) of cigarettes; the lateral walls (14) of the first container (3) varying in height, so as to be the same height as the end walls (15, 16) and the packets (2) of cigarettes close to the end walls (15, 16), and to be smaller in height than the end walls (15, 16) and the packets (2) of cigarettes between the end walls (15, 16).

11. A carton as claimed in claim 4, wherein the first container (3) is formed from a flat first blank (21) comprising two longitudinal crease lines (22); and a number of transverse crease lines (23) defining, between the two longitudinal crease lines (22), a first panel (14') defining a lateral wall (14), a second panel (13') defining the bottom wall (13), and a third panel (14") defining the other lateral wall (14); the first panel (14') having two first tabs (15', 16'), which are located on opposite sides of the first panel (14'), are separated from the first panel (14') by the two longitudinal crease lines (22), and define the end walls (15, 16).

12. A carton as claimed in claim 11, wherein the second panel (13') of the first blank (21) has two second tabs (24), which are located on opposite sides of the second panel (13'), are separated from the second panel (13') by the two longitudinal crease lines (22), and define respective inner portions of the end walls (15, 16); the third panel (14") of the first blank (21) has two third tabs (25), which are located on opposite sides of the third panel (14"), are separated from the third panel (14") by the two longitudinal crease lines (22), and define respective inner portions of the end walls (15, 16); the second and third tabs (24, 25) being so shaped as not to overlap when folded onto the first tabs (15', 16').

13. A carton as claimed in claim 4, wherein the second container (5) is formed from a flat second blank (26) comprising a number of transverse crease lines (27), which define a first panel (8') defining the top wall (8), a second panel (7') defining a lateral wall (7), a third panel (9') defining the bottom wall (9), and a fourth panel (7") defining the other lateral wall (7); the second panel (7') having a first tab (10'), which is separated from the first panel (7') by a longitudinal crease line (28) and defines the end wall (10).

14. A carton as claimed in claim 13, wherein the first, third and fourth panel (8', 9', 7") of the second blank (26) have three respective second tabs (29, 30, 31), which are separated from the corresponding panels (8', 9', 7") by the longitudinal crease line (28), define respective inner portions of the end wall (10), and are so shaped as not to overlap when folded onto the first tab (10').

15. A carton as claimed in claim 1, and further comprising supporting means for holding each packet (2) of cigarettes firmly in place inside the first container (3).

16. A carton as claimed in claim 15, wherein the supporting means comprise at least one partition inserted inside the first container (3).

17. A carton as claimed in claim 16, wherein the supporting means comprise a number of partitions inserted inside the first container (3) and defining a number of pockets, each for housing a respective packet (2) of cigarettes.

18. A carton as claimed in claim 1, and further comprising a first overwrapping of transparent plastic material enclosing the first container (3) together with the group (4) of packets (2) of cigarettes.

19. A carton as claimed in claim 1, and further comprising a second overwrapping enclosing the second container (5).

20. A carton as claimed in claim 19, wherein the second overwrapping is made of transparent plastic material.

21. A carton as claimed in claim 1, wherein each packet (2) of cigarettes is in the form of a parallelepiped having two end walls and a lateral surface, which is bounded by the end walls and defined by two major, respectively front and rear, lateral walls, and by two minor lateral walls; the group (4) of packets (2) of cigarettes comprising one row of packets (2) of cigarettes, in which the major lateral walls of the packets (2) of cigarettes are arranged contacting one another.

22. A carton as claimed in claim 1, wherein each packet (2) of cigarettes is in the form of a parallelepiped having two end walls and a lateral surface, which is bounded by the end walls and defined by two major, respectively front and rear, lateral walls, and by two minor lateral walls; the group (4) of packets (2) of cigarettes comprising two side by side rows of packets (2) of cigarettes, in each of which the minor lateral walls of the packets (2) of cigarettes are arranged contacting one another.

23. A carton as claimed in claim 1, wherein at least one of the longitudinal edges and transverse edges of the first container (3) and the second container (5) are beveled or rounded.

24. A carton as claimed in claim 1, wherein at least one of the walls (7, 8, 9, 10, 14, 15) defining said first and said second container (3, 5) has at least one arc-shaped portion close to one of its edges.

* * * * *